United States Patent [19]

Babitzka et al.

[11] Patent Number: 4,633,837

[45] Date of Patent: Jan. 6, 1987

[54] METHOD FOR CONTROLLING FUEL INJECTION IN INTERNAL COMBUSTION ENGINES AND FUEL INJECTION SYSTEM FOR PERFORMING THE METHOD

[75] Inventors: Rudolf Babitzka, Kirchberg; Ernst Linder, Mühlacker; Wilhelm Polach, Moglingen, all of Fed. Rep. of Germany

[73] Assignee: Robert Bosch GmbH, Stuttgart, Fed. Rep. of Germany

[21] Appl. No.: 779,408

[22] Filed: Sep. 24, 1985

[30] Foreign Application Priority Data

Oct. 6, 1984 [DE] Fed. Rep. of Germany ..... 3436768

[51] Int. Cl.[4] ..... F02D 41/40

[52] U.S. Cl. ..... 123/478; 123/446

[58] Field of Search ..... 123/446, 448, 458, 506, 123/478, 480

[56] References Cited

U.S. PATENT DOCUMENTS

| | | | |
|---|---|---|---|
| 3,575,145 | 4/1971 | Steiger | 123/478 X |
| 3,592,177 | 7/1971 | Wehde | 123/446 X |
| 3,851,635 | 12/1974 | Murtin et al. | 123/478 X |
| 4,475,507 | 10/1984 | Miyaki et al. | 123/458 X |

FOREIGN PATENT DOCUMENTS

| | | | |
|---|---|---|---|
| 32937 | 2/1983 | Japan | 123/446 |
| 47129 | 3/1983 | Japan | 123/446 |
| 128428 | 8/1983 | Japan | 123/506 |

*Primary Examiner*—Tony M. Argenbright

*Attorney, Agent, or Firm*—Edwin E. Greigg

[57] ABSTRACT

To control the fuel injection pressure, in particular in high-pressure injection in self-igniting internal combustion engines, the pumping or supply phase of a cam-driven, intermittently operating pump piston of a fuel injection pump is determined by the closing time of a relief-metering valve and controlled in such a manner that the closing of the relief-metering valve for the supply onset (FB) is earlier, by the amount $\Delta\alpha$, than the opening of control valves by way of which the fuel pumped by the pump piston is supplied to the individual injection locations. By means of the initial pumping amount or pre-stroke ($\Delta h$ or $\Delta\alpha$), fuel is pumped into a closed system, and the injection pressure present at the injection valve at the instant of the opening (SB) is thus controlled.

21 Claims, 5 Drawing Figures

Δh1
Δh
FB
α

FB
FE
α

Δα
SB
α

Δα1
α

METHOD FOR CONTROLLING FUEL INJECTION IN INTERNAL COMBUSTION ENGINES AND FUEL INJECTION SYSTEM FOR PERFORMING THE METHOD

BACKGROUND OF THE INVENTION

The invention is based on a fuel injection system generically defined hereinafter. A system of this kind, known from German Offenlegungsschrift No. 15 76 626, serves to supply fuel to an internal combustion engine that operates with externally supplied ignition and aspirates a fuel-air mixture. Fuel is pumped by a fuel feed pump into a reservoir kept at a constant fuel pressure. From this reservoir, via a throttle and an electromagnetic metering valve, the fuel that is to be injected is metered into an intermediate reservoir during the working stroke of the engine. The intermediate reservoir has a movable wall that yields to a soft spring; the biasing of the spring determines the injection pressure. This injection pressure will be lower in every case than the pressure in the first reservoir mentioned. During the intake stroke, finally, the metered fuel that has been pre-stored in the intermediate reservoir is delivered via second electromagnetic valve to the injection nozzle, which injects the fuel either into the intake tube of the engine or, during the intake stroke, into the combustion chamber.

In controlling the injection quantities for a high-pressure injection in self-igniting internal combustion engines, it is also known for the fuel injection quantity that is to be supplied per cylinder to be controlled by using a relief valve to determine the effective fuel supply provided by a reciprocating pump piston. A fuel injection system of this kind is disclosed in U. S. Pat. No. 3,851,635, in which an intermittently driven pump piston pumps fuel via a check valve into a collecting line, from which injection lines lead away to the individual injection nozzles. Each of these injection lines has a first magnetic valve, downstream of which a relief line branches off from the injection line, and a second magnetic valve is disposed in each relief line. The first magnetic valve serves to trigger the associated injection valve and is switched at the same time as the second magnetic valve, in such a way that the first magnetic valve opens and the second magnetic valve closes, so that an injection takes place. This system is intended in particular to increase the accuracy of the instants of injection.

OBJECT AND SUMMARY OF THE INVENTION

This invention has the advantage over the prior art that by means of the control effected by the single relief valve and the individual control valves, an accurately specified portion of the fuel supply is utilized for attaining a desired fuel pressure at the instant of the injection onset. It is thereby possible to maintain optimal conditions for injection over the entire operating range of the engine. In particular, the fuel injection pressure that is established at the onset of injection can be adjusted independently of the rpm and the supply rate. With the aid of the fuel injection pressure that can be established in this way, the injection rate, that is, the rate at which the fuel passes through the injection nozzles in order to be inJected, can also be adjusted in an intended manner, so that the injection can be optimized in terms of the various operational ranges of the engine. The injection can be designed for low noise during idling and at partial load, and in other engine ranges it can be adjusted for optimal fuel consumption, the very best performace as well as optimum emissions.

Herein is disclosed a fuel injection system which serves to perform a markedly improved method.

Further advantageous developments of the fuel injection system as revealed herein are attainable.

In particular, one embodiment offers the opportunity, when conditions are changing, of quickly establishing the required injection pressure at the particular operating range of the engine at the time.

In a further improvement, the instant the control valve opens determines the actual injection onset, so that this variable can advantageously be regulated exactly for use as a guide parameter.

Moreover, according to an additional advantageous embodiment, the fuel injection pressure that is established can also be regulated with the aid of a pressure transducer, in fact to a set-point value which can accommodate various peripheral parameters and/or can also vary along with continuously varying operating parameters of the engine.

The invention system can advantageously be realized using only a single one-cylinder injection pump, which can be manufactured at a favorable cost and is reliable in operation. The fuel injection quantity that is supplied is distributed via an electric distributor, which is embodied by the individual control valves. By effecting control as recited hereinafter, it is also possible, in particular, to attain quite engine operation during idling and still maintain optimal injection.

The invention will be better understood and further objects and advantages thereof will become more apparent from the ensuing detailed description of a preferred embodiment taken in conjunction with the drawings.

BRIEF DESCRIPTION OF THE DRAWINGS

FIG. 3(*a–c*) shows the control times of the relief valve with respect to the control valves.

DESCRIPTION OF THE PREFERRED EMBODIMENT

Figure 1:
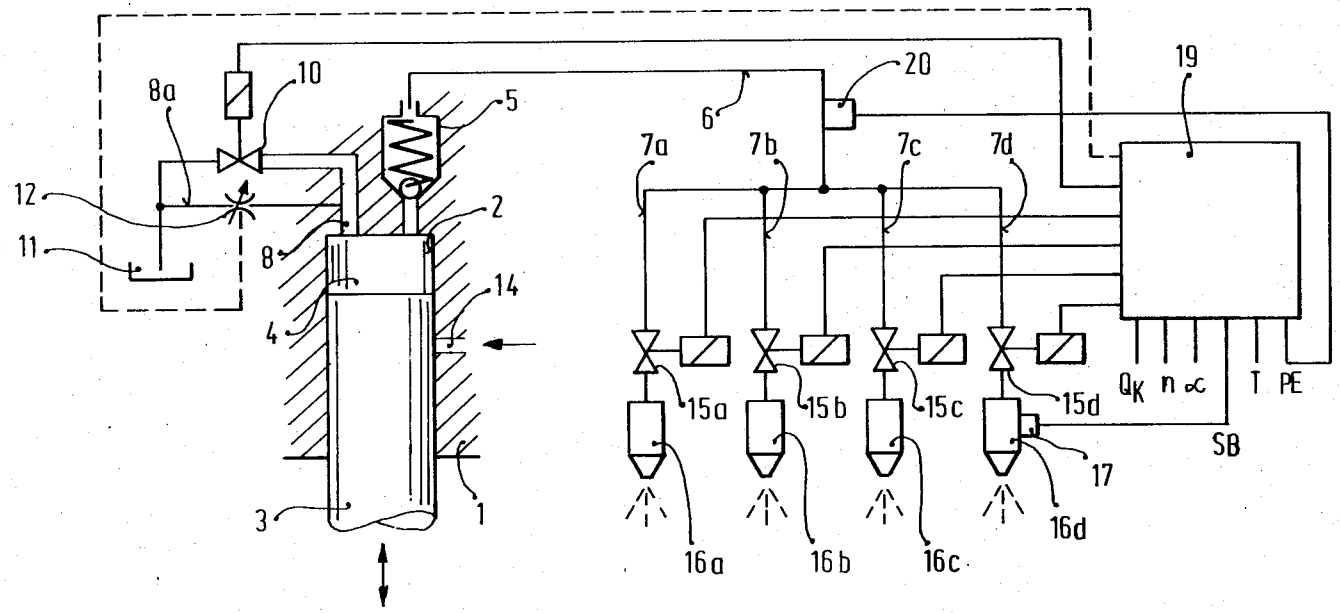
FIG. 1 is a schematic illustration of the exemplary embodiment.

A cylinder 2 that is closed at the end is disposed in a housing 1 of a fuel injection pump, and in it a pump piston 3 is set into a reciprocating pumping and aspirating motion by a cam drive, not shown. This fuel injection pump can be realized, by way of example, as a single-cylinder plug-in pump, which is mounted on the internal combustion engine where it is driven by a cam of the engine. In the cylinder 2, the pump piston 3 with its end face encloses a pump work chamber 4, from which a pressure line leads via a check valve 5 to a collecting line 6, branching off from which are individual injection lines 7*a*, 7*b*, 7*c* and 7*d*. Also branching off from the pump work chamber is a relief line 8, in which an electrically controlled relief valve 10, functioning as a metering valve, is disposed. The relief line leads to a relief chamber, or to the fuel tank 11. In a supplementary version, a parallel relief line 8*a* can be disposed parallel to the relief valve 10 and can have a controllable throttle 12 disposed in it. In the lowermost position of the pump piston, the pump work chamber communicates with a source of fuel via an intake line 14; upon the onset of the pumping stroke of the pump piston, it is separated from this intake line.

In the individual fuel injection lines 7–7*d*, electrically controlled control valves 15*a*–15*d* have been inserted, which control the connection with the fuel injection valves 16*a*–16*d* located at the end of the injection lines 7*a*–7*d*. In a further feature of the invention, one of more of these injection valves are provided with an injection onset transducder 17. Such injection onset transducers can be used as injection duration transducers, and hence as transducers for the injected fuel quantity, at the same time.

The relief valve 10 and the control valves 15*a*–15*d* are controlled by a control unit 19 to which various operating parameters are supplied. Such parameters are, primarily, the rpm and the rotational position of the crankshaft of the internal combustion engine associated with the fuel injection system; the engine is not shown here in detail. Both parameters may be furnished by a single transducer, if needed. Also supplied to the control unit is the desired torque, or the load signal, with respect to the quantity of fuel to be injected. Other possible parameters are the feedback of the injection onset; perhaps the injection quantity; the operating temperature, in particular the temperature characteristic of engine warm-up; perhaps signals relating to the load change or desired acceleration; and in a further feature of the fuel injection system, a control signal corresponding to the fuel pressure established in the collecting line 6 at the onset of injection. This pressure is detected with the aid of a pressure transducer 20.

Figures 2, 3A, 3B, 3C:
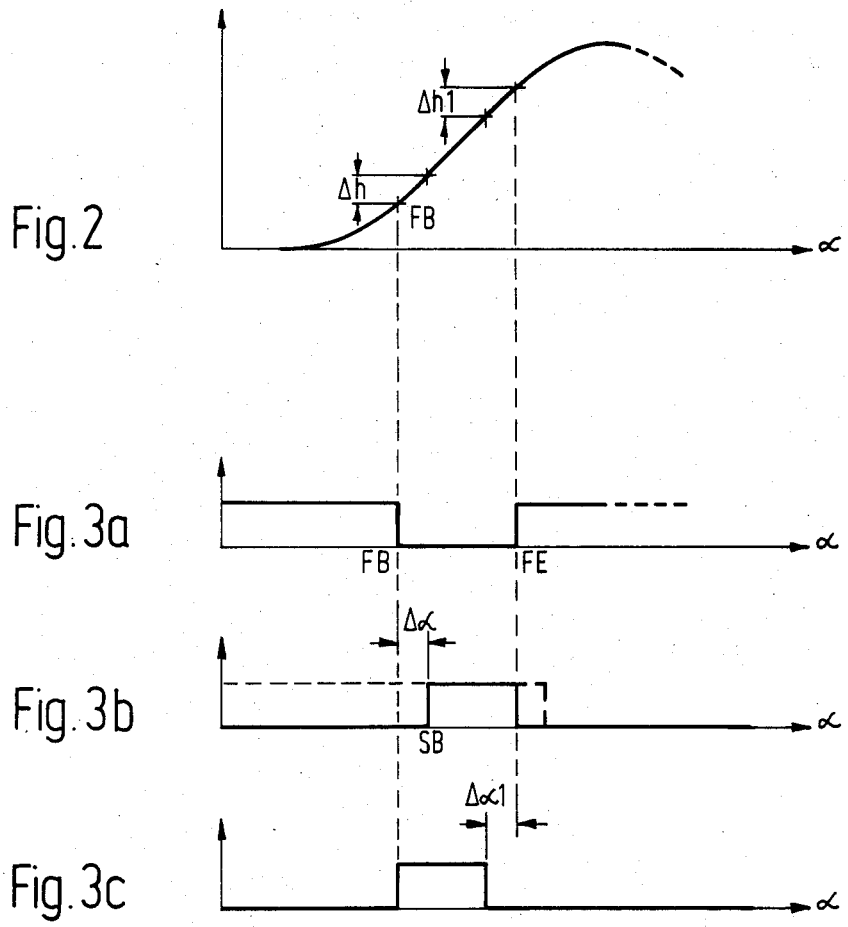
FIG. 2 shows the control times of the relief valve with respect to the cam elevation curve of the cam driving the pump piston.
FIG. 3*a* is the control diagram of the relief valve.
FIG. 3*b* is the control diagram of one of the control valves for a first possible kind of control.
FIG. 3*c* is the control diagram of one of the control valves showing a second possible kind of control in order to attain the desired injection pressure.

The fuel injection system functions as follows:

After the pump work chamber 4 is filled via the intake line 14, in the lowermost position of the pump piston 3, its drive cam causes the pump piston 3 to execute a pumping motion. FIG. 2 shows a portion of such a cam elevation curve over the rotational angle $\alpha$ of the pump drive shaft, or of the engine crankshaft. At the onset of the pumping stroke of the pump piston, the relief line 8 is first opened by the metering valve. Beyond a certain point in the pump piston stroke, indicated at FB on the cam elevation curve here, the metering valve closes, so that the pump piston begins pumping, and pumps fuel out of the pump work chamber 4 via the check valve 5 into the collecting line 6. This point is also indicated in the control diagram of the relief valve, which is shown in FIG. 3*a*, below FIG. 2. As pumping continues, a fuel pressure is built up in the collecting line 6, i.e., up to a certain level, at which one of the control valves 15*a*–15*d* opens. From that instant on, fuel can reach the corresponding fuel injection valve 16, and the injection pressure is so high that in every instance the opening pressure of the injection valve is exceeded. The opening of the control valves thus determines the injection onset SB, which is shown in the control diagram of one of these valves provided in FIG. 3*b*. With the kind of control illustrated in FIG. 3*b*, the control valve 15 thus opens only after a piston stroke $\Delta h$, corresponding to a rotational angle $\Delta\alpha$ after the supply onset FB. The fuel quantity thereby pumped is available for pressurizing the fuel volume in the collecting line 6 and in the injection lines 7*a*–7*d* as far as the individual control valves 15*a*–15*d*. Depending on the amount $\Delta h$, a higher or lower injection pressure is accordingly established at the instant one of the control valves opens. With this preliminary amount prior to the actual onset of injection, the injection pressure can accordingly be advantageously modified regardless of the pumping characteristic of the fuel injection pump. To form the desired injection pressure at various engine operating points, values for the amount $\Delta\alpha$ can advantageously be stored in a performance graph in accordance with various operating parameters, thereby taking into account the required onset of injection, which is also dependent on parameters. For controlling the control valve 15, in particular for the injection onset, the known parameters such as rpm, or in the warm-up phase the engine temperature, and others are taken into consideration.

While in FIG. 3*b* an increase in the injection pressure is attained by a later opening of the control valve, in a different versions the control valves can also be triggered such that they are opened at an angle position FB as shown in FIG. 3*c* but that they already close before the pumping action, which is determined by the reopening of the relief valve 10, is ended. By way of the quantity of fuel pumped after the closure of the control valves, in accordance with the rotational angle $\Delta\alpha_1$, a standing pressure builds up in the collecting line 6 and in the parts of the injection lines in the same manner as described above; this pressure is effective at the next subsequent injection onset, or pumping onset. Compared with this, the embodiment of FIG. 3*b* with the initial pumping amount $\Delta\alpha$ has the advantage that the high injection pressure is effective only briefly and can also be influenced rapidly prior to the injection onset.

In the embodiment according to FIG. 3*b*, the control valve remains open after the injection onset SB until such time as the quantity of fuel metered by the relief valve has been injected. The relief valve thus defines the end of supply FE. If the check valves are lacking, then the injection is interrupted immediately, even if the control valve 15 is still open. This provides the opportunity, with this form of control, of keeping the opening duration of the control valves constant, with a sufficient length that here only the injection onset needs to be controlled exactly. On the other hand, if a check valve is used, the injection duration can last beyond the end of supply. The larger the value $\Delta\alpha$ is, the higher is the injection pressure present at the injection valve, and this pressure in turn produces an increased injection rate over the injection duration at the injection valve, which is shortened as compared with the pumping period extending from FB to FE. The injection rate is advantageously reduced for the low-load or idling range, in that during the pumping phase fuel can flow out in a controlled manner in the bypass via the variable throttle 11 in the parallel relief line 8*a*. This throttle, also, is controlled by the control units 19.

Instead of a control unit which is provided with performance graph memories for the parameters of the injection onset, on the one hand, and the parameters of the injection pressure, on the other, the injection onset can also be controlled in an analog fashion, with feedback of the injection onset via the injection onset transducer 17, which is the point of departure for calculating the initial amount $\Delta\alpha$. In a further feature, the pressure that is to be established in the collecting line 6 can also be regulated, by detecting the actual pressure via the pressure transducer 20 and comparing it with a set-point value and varying the amount $\Delta\alpha$ or $\Delta h$ in accordance with the deviation of the actual value from the set-point value. The set-point value can be controlled in an analog manner, or else it can be called up from a performance graph in accordance with the relevant operating parameters.

The fuel injection system is designed from the standpoint of the injection pump such that the pump piston generates the maximum fuel injection pressure at the maximum rpm or maximum pumping, taking the the mechanical, static and dynamic loads into consideration. The lower injection pressure that is typically established at a relatively low rpm can be increased by the above-described invention up to this maximum value for mechanical strength. To assure identical injection conditions at each cylinder, it is advantageous for the injection lines to the individual injection valves to be equal in length. Controlling the pumping phase of the pump piston independently of the mechanical drive also makes it possible to exploit various points of the cam elevation curve for the pumping, as a result of which various pumping rates are attainable, given a corresponding embodiment of the drive cams. Examples of valves that are suitable as the control valves and the relief valve are fast-switching magnetic valves or fast, electrically controlled valves having piezo-type adjusting elements of known types.

The foregoing relates to a preferred exemplary embodiment of the invention, it being understood that other variants and embodiments thereof are possible within the spirit and scope of the invention, the latter being defined by the appended claims.

What is claimed and desired to be secured by Letters Patent of the United States is:

1. A method for controlling fuel injection in internal combustion engines with the generation of a fuel injection pressure by a fuel pump, comprising the steps of:

metering a portion of the fuel pumped by the fuel pump by means of an electrically control relief-metering valve;

controlling the injection of the pumped fuel and the metered fuel at staggered times, with respect to control time of the relief-metering valve, by means of at least one electrically controlled control valve which extends to a nozzle means;

establishing an injection pressure at an injection valve at the onset of injection (SB) as the result of an intermittent pumping of fuel in synchronism with the engine rpm; and influencing said injection pressure so that a variable portion, the variation being in accordance with operating parameters, of the pumped fuel determined by the relief-metering valve is pre-pumped into the injection line that is closed by the control valve.

2. A fuel injection system having a fuel injection pump with a pump work chamber and piston for pumping fuel and generating a fuel injection pressure, an electrically controlled relief metering valve;

a control unit therefor;

said control unit adapted to meter the quantity of fuel through injection lines supplied to one of the cylinders per working stroke of an engine;

each of said lines extending to an injection valve, a control valve in proximity to said injection valve controlled by said electric control unit for controlling the instant of injection, said fuel injection pump adapted to be driven in synchronism with said engine;

further that said relief-metering valve is disposed in a relief line which leads away from said pump work chamber;

said pump work chamber adapted to communicate with a collecting line to supply fuel to said injection valve and said relief-metering valve adapted to be triggered by said control unit whereby upon closure of said relief-metering valve the duration and the onset of the pressure pumping of fuel by said pump piston are determined; and further that said control valve is triggered so that opening duration thereof can be decreased in comparison with the duration of the pressure pumping in accordance with engine operating parameters, and the opening point (SB) is variable in accordance with engine operating parameters.

3. A fuel injection system as defined by claim 2, further wherein said relief-metering valve is closed prior, by the amount of variable pump piston stroke to the opening of said control valve.

4. A fuel injection system as defined by claim 2, further wherein said control valve is closed by the amount of a variable pump piston stroke prior to the reopening (FE) of said relief-metering valve, which reopening terminates supply and metering phase.

5. A fuel injection system as defined by claim 2, further wherein said opening duration of said control valve as the point determining the injection onset (SB), is controlled in an analog manner in accordance with only parameters significant for the injection onset.

6. A fuel injection system as defined by claim 3, further wherein said variable pump piston stroke over which said pump piston pumps into said collecting line, closed by said control valves, is shortened with increasing rpm.

7. A fuel injection system as defined by claim 5, further wherein said variable pump piston stroke over which said pump piston pumps into said collecting line closed by said control valves is controlled in accordance with the deviation of an actual pressure in said collecting line prior to injection onset, said actual pressure being detected by a pressure transducer, from a set-point pressure value.

8. A fuel injection system as defined by claim 5, further wherein said variable pump piston stroke over which the pump piston pumps into said collecting line closed by said control valve is controlled in accordance with a plurality of data stored in a performance graph.

9. A fuel injection system as defined by claim 2, further wherein said pump work chamber communicates with said collecting line via a check valve which opens in the pumping direction.

10. A fuel injection system as defined by claim 9, further wherein a plug-in pump driven by said engine is used as said injection pump.

11. A fuel injection system as defined by claim 8, further wherein in a selected operating range of said engine, in particular during idling operation or low-load operation, said variable pump piston stroke over which the pump piston pumps into said collecting line closed by said control valve is kept as small as possible in order to attain a low fuel injection rate.

12. A fuel injection system as defined by claim 8, further wherein in a selected operating range of said engine, in particular during idling operation or low-load operation, said closing point of said control valve is located after the reopening (FE) of said relief-metering valve at the end of said pumping phase.

13. A fuel injection system as defined by claim 2, further wherein a plurality of control valves are utilized and said lines between said pump work chamber and each of said control valves and their associated injection valves are of equal length.

14. A fuel injection system as defined by claim 2, further wherein an adjustable throttle controlled by said control unit is disposed parallel to said relief-metering valve.

15. A fuel injection system as defined by claim 3, further wherein a plurality of control valves are utilized and said lines between said pump work chamber and each of said control valves and their associated injection valves are of equal length.

16. A fuel injection system as defined by claim 4, further wherein a plurality of control valves are utilized and said lines between said pump work chamber and each of said control valves and their associated injection valves are of equal length.

17. A fuel injection system as defined by claim 5, further wherein a plurality of control valves are utilized and said lines between said pump work chamber and each of said control valves and their associated injection valves are of equal length.

18. A fuel injection system as defined by claim 6, further wherein a plurality of control valves are utilized and said lines between said pump work chamber and each of said control valves and their associated injection valves are of equal length.

19. A fuel injection system as defined by claim 7, further wherein a plurality of control valves are utilized and said lines between said pump work chamber and each of said control valves and their associated injection valves are of equal length.

20. A fuel injection system as defined by claim 8, further wherein a plurality of control valves are utilized and said lines between said pump work chamber and each of said control valves and their associated injection valves are of equal length.

21. A fuel injection system as defined by claim 2, further wherein said opening duration of said control valve as the point determining the injection onset (SB), is controlled in an analog manner in accordance with performance graph data.

* * * * *